US009292000B2

(12) United States Patent
Lamarche

(10) Patent No.: US 9,292,000 B2
(45) Date of Patent: Mar. 22, 2016

(54) MULTIFUNCTIONAL CASE

(75) Inventor: Fabien Lamarche, Le Locle (CH)

(73) Assignee: I.M.H. Innovations Manufacturers Horlogeres SA (CH)

( * ) Notice: Subject to any disclaimer, the term of this patent is extended or adjusted under 35 U.S.C. 154(b) by 17 days.

(21) Appl. No.: 14/004,785

(22) PCT Filed: Mar. 22, 2012

(86) PCT No.: PCT/EP2012/055067

§ 371 (c)(1),
(2), (4) Date: Sep. 12, 2013

(87) PCT Pub. No.: WO2012/126978

PCT Pub. Date: Sep. 27, 2012

(65) Prior Publication Data

US 2014/0003200 A1 Jan. 2, 2014

(30) Foreign Application Priority Data

Mar. 23, 2011 (CH) ..... 0523/11

(51) Int. Cl.

| | |
|---|---|
| ***G04B 3/00*** | (2006.01) |
| ***G04B 7/00*** | (2006.01) |
| ***G04B 5/00*** | (2006.01) |
| ***G04D 7/00*** | (2006.01) |

(52) U.S. Cl.

CPC ..... *G04B 7/00* (2013.01); *G04B 3/006* (2013.01); *G04B 5/00* (2013.01); *G04D 7/009* (2013.01)

(58) Field of Classification Search

CPC ..... G04B 3/006; G04C 1/00; G04C 1/04; G04C 1/06–1/067; G04D 7/009

USPC ..... 81/7.5

See application file for complete search history.

(56) References Cited

U.S. PATENT DOCUMENTS

| | | | | |
|---|---|---|---|---|
| 2,712,231 | A * | 7/1955 | Frolow | 73/1.46 |
| 3,765,223 | A * | 10/1973 | Schar | 73/1.45 |
| 5,988,871 | A * | 11/1999 | Bonnet | 368/206 |
| 6,254,270 | B1 * | 7/2001 | Agnoff | 368/206 |
| 6,439,761 | B1 * | 8/2002 | Agnoff | 368/206 |
| 6,543,929 | B1 * | 4/2003 | Agnoff | 368/206 |
| 6,910,802 | B2 * | 6/2005 | Rustioni | 368/206 |
| 6,964,513 | B1 * | 11/2005 | Agnoff | 368/206 |
| 7,198,401 | B2 * | 4/2007 | Louie | 368/206 |
| 7,530,733 | B2 * | 5/2009 | Louie | 368/206 |
| 7,927,009 | B2 * | 4/2011 | Huang | 368/206 |
| 2005/0254352 | A1 * | 11/2005 | Wolf, V et al. | 368/206 |
| 2007/0097797 | A1 * | 5/2007 | Agnoff | 368/206 |
| 2007/0159929 | A1 * | 7/2007 | Louie | 368/206 |
| 2007/0223319 | A1 * | 9/2007 | Hill | 368/206 |

(Continued)

FOREIGN PATENT DOCUMENTS

EP 2280321 A1 2/2011

*Primary Examiner* — Amy Cohen Johnson
*Assistant Examiner* — Jason Collins
(74) *Attorney, Agent, or Firm* — Blank Rome LLP

(57) ABSTRACT

A multifunctional case is configured for winding an automatic or manual watch having one or more displays, the case includes a box having a removable support designed to hold the watch; a winding mechanism intended to wind the watch when the latter is arranged on the removable support; the multifunctional case also having an adjusting mechanism configured for adjusting said one or more displays of the watch. This solution has in particular the advantage over the prior art of keeping the watch on time when it is arranged in the case.

23 Claims, 4 Drawing Sheets

(56) References Cited

U.S. PATENT DOCUMENTS

2008/0247278 A1 10/2008 Walker et al.
2009/0225632 A1* 9/2009 Agnoff ..... 368/207
2011/0026374 A1* 2/2011 Chang ..... 368/206
2011/0170380 A1* 7/2011 Moroni et al. ..... 368/206

* cited by examiner

MULTIFUNCTIONAL CASE

RELATED APPLICATION

This application is a National Phase of PCT/EP2012/055067, filed on Mar. 22, 2012, which claims the priority of Swiss Patent Application CH00523/11, filed on Mar. 23, 2011, the entire contents of both of which are hereby incorporated by reference.

TECHNICAL FIELD

The present invention relates to a case in which a watch can be placed when it is not worn. It relates more particularly to a case designed for winding an automatic or manual watch (4) having one or more displays.

STATE OF THE ART

Many cases are known and have been systematically used, in particular, by most watch manufacturers to supply their watches to their clients, above a certain price range. In the case of mechanical watches with manual and automatic winding, these cases are often provided with means for winding the watch. This is all the more necessary in that these mechanical watches are often precious and will not be worn regularly, for example only during the weekend or only for certain occasions. A case that makes it possible to automatically wind mainspring mechanisms is thus particularly advantageous for timepieces having many functions, in order to avoid the tedious work of setting the time, the date and the moon phases etc. when the watch is not wound regularly each day. However, due to the running precision of the watch, these adjustments can however prove necessary after a certain period of time. It would thus be advantageous to provide a case that also allows these kinds of adjustments in particular if the watch ends up dwelling in the case during extended periods. Furthermore, since fine watchmaking mechanical watches comprise complex mechanisms, they generally need regular monitoring that usually involves a diagnostic test, performed at the watchmaker's workshop by means of specialized measuring equipment. It would thus be advantageous to provide a case that could also comprise a device enabling a remote diagnosis of the watch. Finally, such a connection would also enable a direct and privileged relationship to be established between the customer and the manufacturer, for example for commercial purposes.

BRIEF SUMMARY OF THE INVENTION

The present invention relates to a multifunctional case device for winding an automatic or manual watch (or several) having one or more displays, comprising a box comprising a removable support designed to hold the watch; a winding mechanism intended to wind the watch when the latter is arranged on the removable support; characterized in that the multifunction device further comprises one or several devices such as an adjusting mechanism suitable for adjusting said one or more displays.

In one embodiment, the adjusting mechanism is suitable for adjusting said one or several displays among: hours display; minutes display; seconds display; date, display of the moon phases; calendar, wake-up time. The adjusting mechanism can also be designed for adjusting said one or several displays according to the current time and/or date.

In another embodiment, the current time and/or date can be synchronized by means of a remote reference system. Said remote reference system can include receiving a radio or GPS signal or an Internet communication device.

In yet another embodiment, the case can further include visualization means enabling an image of said one or several displays of the watch to be recorded. The visualization means can include a camera. The camera can be a camera integrated within an apparatus of the type microcomputer, multimedia telephone or communicating tablet. The case can also include analysis means for analyzing the image of said one or several displays of the watch in order to determine a value of said one or several displays among: the hour; the minutes; the seconds; the date, moon phases; the calendar; the wake-up time. The analysis means can also enable a gap between the value of said one or several displays and the current time and/or date to be ascertained, in order to determine a running state of the watch.

In yet another embodiment, the case can include a tracking device designed to determine a localization value of the case. The adjusting mechanism can be adapted for using the localization value so as to adjust said one or several displays according to the local time zone.

In yet another embodiment, the case can also include a display device onto which the camera's image is transmitted. The display device can include a touch function and enable the adjusting mechanism to be controlled so as to select one of said one or several displays adjusted by the adjusting mechanism.

In yet another embodiment, the case can include a control electronics controlling the adjusting mechanism so as to select one of said one or several displays adjusted by the adjusting mechanism.

In yet another embodiment, the case can include an acoustic measuring device for determining a frequency and/or amplitude of the movement of the watch so as to ascertain a running state of the watch. The acoustic measuring device can include a microphone integrated in the support and designed for measuring the shocks of an escapement of a watch movement.

In yet another embodiment, the case can include an optical measuring device designed for visually measuring oscillations of the balance of the watch movement.

In yet another embodiment, the case can include communication means for communicating the running state of the watch to an external service. In this manner, the case is capable of supplying an audio or visual remote diagnosis of the running and amplitude of the watch, with the measured parameters being sent to the manufacturer's by means of a wired or wireless Internet connection. Furthermore, the visualization means and the display device can be adapted for a user to enter information and for information supplied by the external service to be displayed. Said information can include information on after-sale services, technical solutions and/or information regarding new products and new commercial offers.

The present invention also relates to a multifunctional case in combination with an automatic or manual watch (4) and having one or several displays.

This solution notably has the advantage over the prior art of maintaining the watch on time and keeping up-to-date the other displays such as the date when the watch is placed in the case. Other advantages will be made evident in the course of the following non-limiting description.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
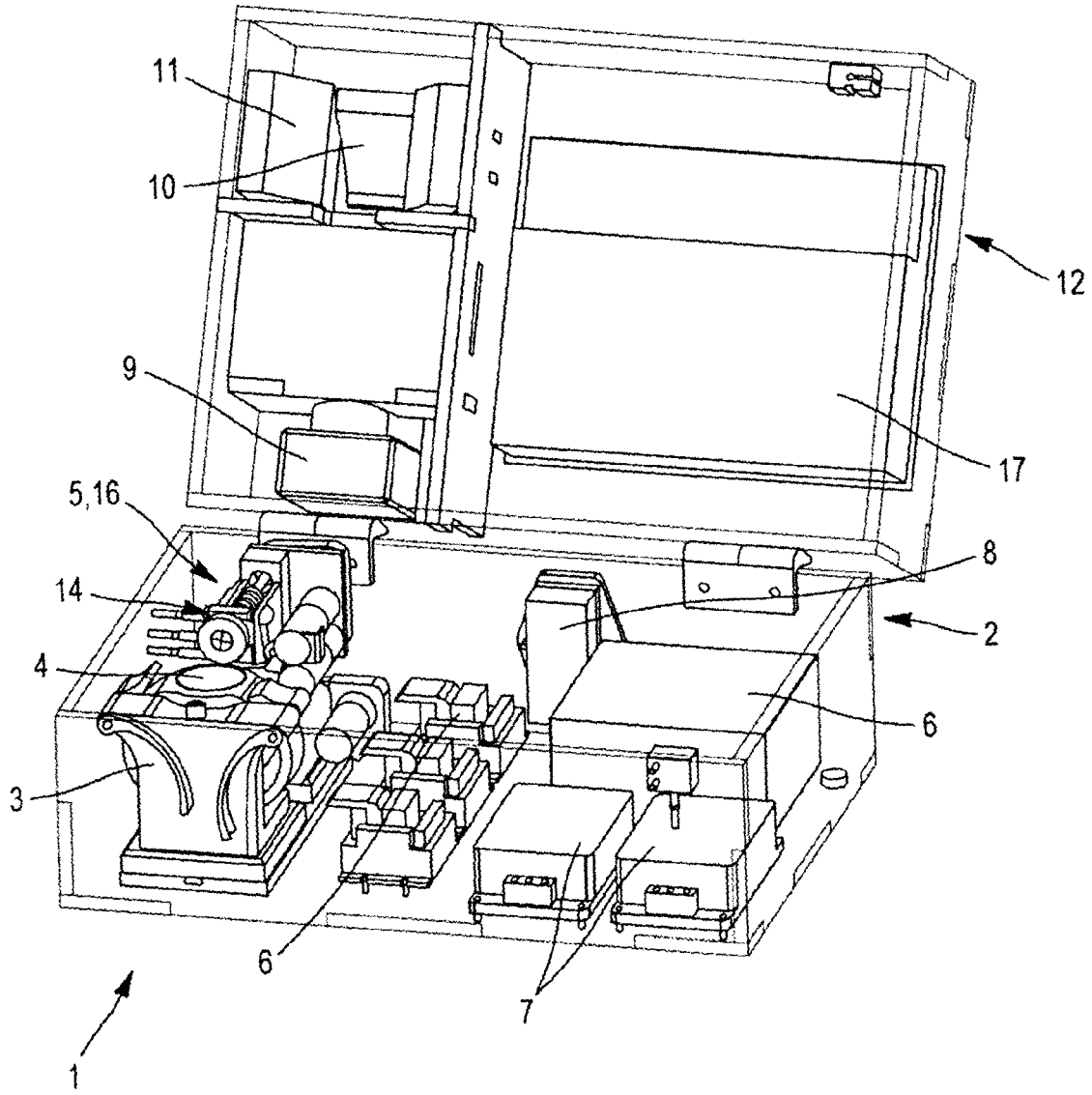
FIG. 1 illustrates a case with a multifunctional case according to one embodiment of the invention.

In one embodiment, shown in FIG. 1, a multifunctional case 1 for winding an automatic or manual watch 4 includes one or several displays (not represented). The multifunctional case 1 is shown in more detail in FIG. 2. The multifunction case 1 comprises a box 2 capable of being opened by means of a lid 12, and in which the watch 4 can be placed when it is not worn. In a preferred manner, the box 2 is made of light materials and has a maximum volume of approximately 7000 $cm^3$ and comprises an electromagnetic shielding (not represented).

Figure 3:
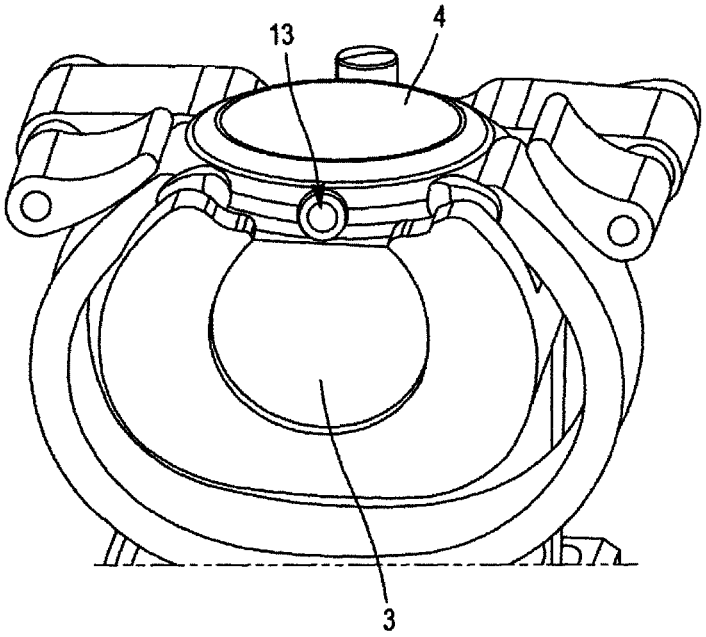
FIG. 3 shows a support of the case according to one embodiment.

A removable support 3 designed to receive the watch 4 is mounted in the box 2. The support 3 can be a chuck having approximately the shape of a wrist, on which the watch 4 is placed and fastened in removable manner at the periphery of the chuck. The support 3 can be modulable depending on the watch 4. Part of the box 2 can be made of a transparent material so that the watch 4, the displays and possibly the support and the various mechanisms described below are visible inside. A detail of the support 3 is shown in FIG. 3.

In one embodiment, the multifunctional case 1 includes a winding mechanism 5 designed for winding the watch 4 when the latter is placed on the removable support 3. The winding mechanism 5 can be adapted for winding watches with automatic winding as well as watches with manual winding. Furthermore, the winding mechanism 5 is such that it makes it possible to leave the watch 4 stationary in the case without interruption in the running of the watch 4 whilst maintaining good time-keeping accuracy.

Figure 2:
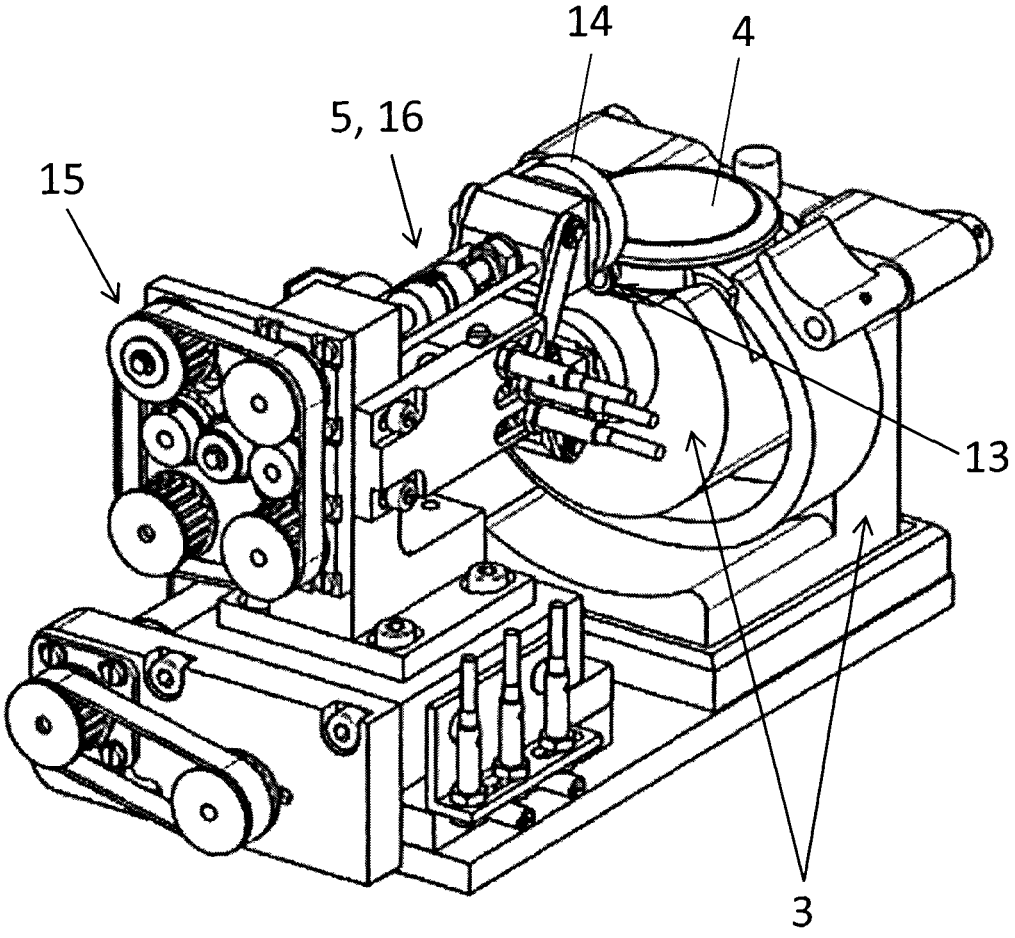
FIG. 2 shows the multifunctional case according to one embodiment.

According to one embodiment, the winding mechanism 5 is adapted for winding a manual winding watch and includes driving means 15 that drive in rotation a connecting member 14 between the driving means 15 and a winding member 13 of the watch. In the example of FIG. 2, the watch 4 comprises a crown 13 topping a winding stem. The connecting member 14 is arranged to engage with the crown 13 when the watch 4 is placed on the support 3. For example, the support 3 can be arranged so that the watch 4 is positioned in a sufficiently accurate manner relative to the connecting member 14, so that the latter engages with the crown 13 when the watch 4 is placed on the support 3. As illustrated in FIG. 2, the connecting member can have the shape of a knurling-roller 14 capable of cooperating with the rim of the winding member 13 of the watch 4. Alternatively, the connecting member 14 can also have any other shape or form such as a tubular part (not represented) having a housing capable of adapting to the crown 13 or also a collet (also not represented) adapted for meshing with the crown 13. The winding mechanism 5 is arranged for driving the crown 13 in rotation so as to wind the watch 4. This winding can be performed at regular intervals for a predetermined period of time, for example during the time when the watch is placed in the box 2.

The connecting device 14 can be specific to each type of watch. The winding mechanism 5 can further comprise a coupling device (not represented) placed between the connecting device 14 and the driving means 15 for disengaging the rotation of the connecting device 14 in case the winding torque becomes too high.

The multifunctional case 1 can also include control electronics 6 which can be of the type "onboard microcomputer" provided with a control interface and having a timepiece and a motor for driving in rotation the driving means 15. The control electronics 6 can advantageously control the duration of the rotation of the connecting device 14 and thus of the winding of the watch 4 as well as the frequency at which the watch 4 is wound. Combining the control of the winding duration and of the winding frequency will make it possible to ensure the watch is sufficiently wound. The control electronics 6 can also be used for controlling the winding torque to ensure that the watch is wound sufficiently and stop the winding and/or disengage the rotation of the connecting device if the winding torque becomes too high. The control electronics 6 is powered by a standard electric supply 7 and an international plug 8 for connection to the mains.

Alternatively, the winding mechanism 5 is adapted for winding a watch with automatic winding. For example, it includes means for directly driving the support 3 so as to set the watch 4 in motion when the watch 4 is placed on the support 3. For example, the support 3 can be mounted in pivoting fashion in the box 2 and be put in rotation and/or oscillation, or in any other motion appropriate for winding the automatic watch, by the driving means 15. The means for driving the support 3 can also be combined with the manual winding device described here above.

In one embodiment, the multifunctional case 1 further includes an adjusting mechanism 16 enabling the one or several displays (not represented) of the watch 4 to be adjusted (or corrected). The adjusting mechanism 16 can include driving means 15 driving the connecting member 14 designed to mesh with an adjusting member 13 of the display. For example, the display can comprise a first display for displaying the hour and the minutes (and the seconds), and wherein the adjusting mechanism 16 is arranged for adjusting the hour and minutes of the first display according to a value of the current time. The first display's time setting can be achieved through the connecting device 14, driven by the driving means 15 meshing with the crown 13 topping the winding stem. By way of example, the adjusting mechanism 16 is arranged for pulling the winding stem in a first pulled position, and driving the crown in rotation so as to adjust the position of the hours and minutes hands of the watch 4. It is obvious that the adjusting mechanism 16 can also be adapted for controlling other types of adjusting members of the display. For example, such adjusting members can have the form of one or several push-pieces.

Figure 4:
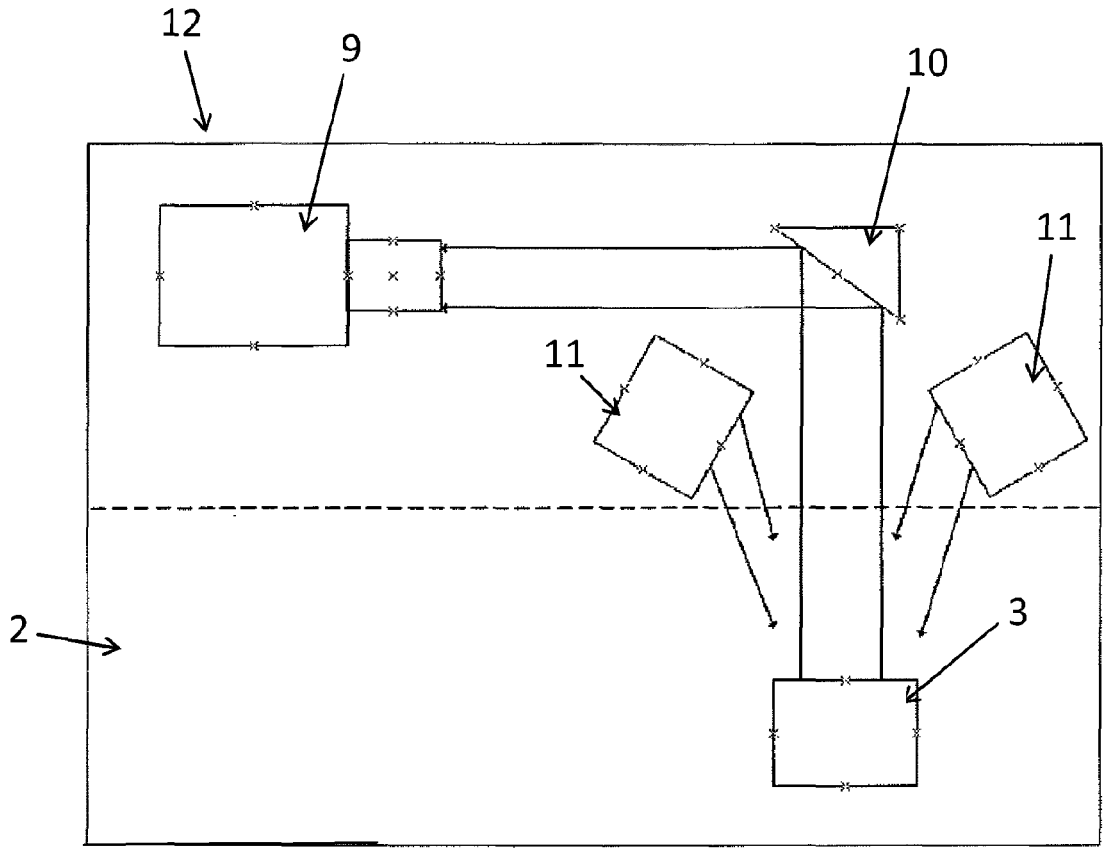
FIG. 4 illustrates visualization means according to one embodiment.

In another embodiment, the multifunctional case has visualization means. By way of illustration, the visualization means comprise a camera 9 placed in such as way as to visualize the watch 4 and record a picture of said one or several displays of the watch 4. For example, the camera 9 can visualize the position of the hours and minutes hands on a dial of the watch 4. In the example of FIG. 1, the visualization means also include a mirror 10 in the optical path between the camera 9 and the watch 4. This arrangement, shown in more detail in FIG. 4, is advantageous in terms of its small footprint. Light sources 11 are also placed so as to light the dial of the watch 4. The camera 9 can furthermore also advantageously be replaced by a camera integrated within a computer or communicating device of the smartphone or tablet type.

Analysis means enable the image of said one or several displays of the watch 4 to be analyzed so as to determine a value of said one or several displays (such as the hour; minutes; seconds; date, moon phases; calendar, wake-up time). The analysis means further enable a gap between the value of said one or several displays and the current time and/or date to be ascertained. For example, the analysis means can make it possible to analyze the position of the hours and minutes hands on the dial, recorded by the camera 9. This allows the time displayed by the watch 4 to be determined. The time displayed by the watch 4 can be compared with a current reference time and/or date. In case the time displayed and the current reference time differ, the adjusting mechanism enables the first display to be set to the current reference time.

The current time can be supplied by a control clock comprised in the multifunctional case. In a preferred embodiment, the current time and/or date is synchronized by means of a remote reference system, for example by means of receiving a radio or GPS signal or by Internet.

In another embodiment, the adjusting mechanism 16 makes it possible to set the time according to the current reference time within a predetermined time zone. The selection of the predetermined time zone can be achieved by a user's choice. By way of illustration, the multifunction case can include the possibility of selecting a city or time zone, for example by means of one or several selection buttons. It is possible to set the time on the basis of a shift in hours or fractions of hours, depending on the selected time zone.

In a variant of the embodiment, the adjusting mechanism 16 includes a tracking device (not represented) for localizing the multifunctional case 1, i.e. for determining a localization value of the case 1, so as to perform the appropriate correction depending on the local time zone, i.e. to adjust said one or several displays depending on the local time zone.

The watch 4 can include other displays. For example, the watch can have a second display for displaying the date. By way of illustration, the date display comprises a display of the day of the month in the form of a numeral in an aperture. It can also be a display for both the date and the day of the week. The date display can also be achieved by means of a retrograde hand on a dial or any other suitable type of display.

Adjusting the date display can be achieved by means of the connecting device 14. In this case, the adjusting mechanism 16 is arranged so as to be able to pull the winding stem into a second pulled position and drive the crown 13 in rotation so as to adjust the date. For example, the date can be corrected by turning the crown 13 in a first direction and the date of the week can be corrected by turning the crown 13 in a second direction opposite to the first. Other arrangements can of course be implemented for adjusting the date.

As in the time adjustment here above, adjusting the date display can be performed in relation to a current reference date. The current reference date can be determined by one of the means described here above, i.e. supplied by the control clock or synchronized by receiving a radio or GPS signal or by an Internet communication device or other. The comparison of the displayed date with the current reference date for determining the date adjustment to be performed can also be based on the image recorded by the camera, comprising also the date, and by its analysis. This device further makes it possible to comply with the time windows when such an adjustment is not to be performed so as to not damage the watch's mechanism.

The adjusting mechanism 16 can also be arranged so that, during time setting according to the current reference time in a predetermined time zone, the adjusting mechanism adjusts not only the displayed time (the position of the hands, for example of the hours, minutes, seconds) but also the date.

It can be that the watch 4 has other displays than those mentioned here above. For example, the watch 4 can include a display of the moon phases, of the tides, a wake-up function, a GMT function etc. The adjusting mechanism 16 described here can be arranged so as to be able to correct the displays of the different displays and of the different complications, each according to a current reference value (for example, the current time and/or date) in a manner similar to the one described here above. It will be understood here that the adjusting mechanism 16 of the case 1 is adapted for adjusting different types of displays, including for example: an hours display; a minutes display; a seconds display; a date, a display of the moon phases; a calendar; or also a display of the wake-up time. The adjusting mechanism 16 is further suitable for adjusting said one or several displays according to the current time and/or date.

The adjusting mechanism 16 is arranged so as to achieve the adjustment of the different displays of the watch 4 in less than three minutes, notably by using the control electronics 6 coordinating the action of the components of the adjusting mechanism 16.

According to one embodiment, the multifunctional case 1 makes it possible to select the execution of one of the different functions, including the time set, the adjustment of the date and of the different complications of the watch, and the winding, or of a combination of these functions. The execution of one or of a combination of these functions can also be planned according to a maintenance program comprising, for example, a periodic verification of the running state of the watch 4 and its periodic winding, as well as the time setting and adjustment of the date and of the different complications of the watch, in a periodic manner. It is conceivable, for example, to provide a winding every thirty hours, a time setting every week and the adjustment as required. For this purpose, the adjusting mechanism 16 can be controlled by the control electronics 6 so as to select one of said one or several displays being adjusted by the adjusting mechanism 16. The control electronics 6 can itself be controlled by the maintenance program (in the form of a computer code, for example), or by manual entering means, by a user, through an interface such as selection keys or a touch display device 17 (see below).

In another embodiment, the multifunctional screen 1 is also adapted for determining a running state of the watch (in other words, for performing a measurement or diagnostic test of the running of the watch 4), for example on the basis of the time settings and adjustments necessary during the program. For example, the case can include analysis means for analyzing the image of said one or several displays of the watch 4 (for example the hour; minutes; seconds; date, moon phases; calendar; wake-up time) in order to determine the gap between the value of said one or several displays and the current time and/or date. The running state of the watch can then be based on the ascertained gap. Alternatively, the case 1 can also include an optical measuring device (not represented) designed for the visual measurement of the oscillations of the balance of the watch 4's movement. For example, the optical measuring device can be an optoelectronic sensor (also not represented) placed in the support 3. The measurement of the balance's oscillations enables the watch's running state to be determined.

In one embodiment, not represented, the case 1 further includes an acoustic measuring device for determining a frequency and/or amplitude of the movement of the watch 4 so as to ascertain the running state of the watch. The acoustic measuring device can include a microphone integrated in the support 3 and capable of measuring the shocks of an escapement of the movement, and audio analysis means by means of a microphone integrated in the support 3. Measuring the running state of the watch 4 and/or the gap between the value of said one or several displays and the current time and/or date can be communicated to an external service, for example an external maintenance center, an after-sales service of a shop or of the manufacturer. To this effect, the multifunctional case 1 can include communication means (not represented), for example via an Internet communication device, or via WIFI wave transmission means or via any other communication means in order to transfer information related to the watch's running state to the maintenance center. In this manner, remote diagnosis means for the good running state of the watch 4 are obtained. The communication means can also be used for synchronizing and receiving the radio or GPS signal.

The box 2 can include a display device 17, typically an LCD-type screen, which can be located at any place of the box 2, inside or on an outer part of the latter, on its lid 12 or on its lateral part. The display means can be used for displaying the measurement of the running and/or of the image from the camera 9. The display device 17 can also include a touch function (for example a touch screen 17) for entering a selection for controlling the adjusting mechanism 16 so as to select one of said one or several displays adjusted by the adjusting mechanism 16. For example, the adjusting mechanism 16 can thus be controlled for starting one of the different functions including time setting, adjustment of the date and of the different complications of the watch 4, and the winding or of a combination of these functions. In one embodiment, the image recorded by the camera 9 can be visualized from outside the box 2. For example, the box 2 can comprise an LCD screen 17 or other for transmitting the image recorded by the camera 9. Such an arrangement enables the watch 4 to be visualized when contained in the box 2. This arrangement makes it possible to visualize the watch 4 when it is contained in the box 2. This arrangement also enables the displays of the watch 4 to be seen, i.e. the time, as well as the other functions (date and other complications) displayed by the watch. In the example of FIG. 1, the screen 17 is mounted onto the lid 12 of the box 2, with the display on the outer side of the lid 12.

In yet another embodiment, the visualization means 9 and the display device 17 are adapted for a user to enter information and for information supplied by the external service to be displayed. The information can be communicated between the case 1 and the external service through the communication means. The information can include information on after-sale services, technical solutions and/or information regarding new products and new commercial offers.

It is obvious that the present invention is not limited to the embodiment which has just been described and that various modifications and simple variants can be conceived by the one skilled in the art while remaining within the scope of the present invention. For example, the case 1 can include two or several adjusting mechanisms 16 adapted for adjusting said one or several displays of two or several watches 4 of the same type or of different types. The case 1 can also include more than one of said visualization means 9 enabling an image of said one or several displays of the two or more watches 4 to be recorded. The case 1 can also include more than one said display device 17 for transmitting the image of each of said two or more watches 4 onto each of said more than one said display device 17.

REFERENCE NUMBERS USED IN THE FIGURES

1 multifunctional case
2 box
3 support
4 watch
5 winding/setting mechanism
6 control electronics
7 electric power supply
8 plug
9 camera
10 mirror
11 light sources
12 lid
13 crown
14 connecting member
15 driving means
16 adjusting mechanism
17 LCT/touch screen

The invention claimed is:

1. Multifunctional case adaptable for winding an automatic or manual watch, said watch comprising one or more displays, the case comprising a box comprising a removable support designed to hold the watch;

a winding mechanism intended to wind the watch when the latter is arranged on the removable support; and an adjusting mechanism configured for adjusting said one or more displays of the watch.

2. Multifunction case according to claim 1, wherein the adjusting mechanism is adapted for adjusting one or several displays among: hours display; minutes display; seconds display; date, display of the moon phases; calendar, wake-up time.

3. Multifunction case according to claim 1, wherein the adjusting mechanism is adapted for adjusting said one or several displays according to the current time and/or date.

4. Multifunction case according to claim 3, wherein the current time and/or date are synchronized by means of a remote reference system.

5. Multifunction case according to claim 4, wherein said remote reference system includes receiving a radio or GPS signal or an Internet communication device.

6. Multifunction case according to claim 1, wherein the adjusting mechanism is arranged so as to achieve the adjustment of said one or several displays in less than three minutes.

7. Multifunction case according to claim 1, further including visualization means enabling an image of said one or several displays of the watch to be recorded.

8. Multifunction case according to claim 7, wherein the visualization means comprises a camera.

9. Multifunction case according to claim 8, wherein the camera is a camera integrated within an apparatus of the type microcomputer, multimedia telephone or communicating tablet.

10. Multifunction case according to claim 8, further including a display device onto which the image from the camera is transmitted.

11. Multifunction case according to claim 10, wherein the display device includes a touch function and enables the adjusting mechanism to be controlled so as to select one of said one or several displays adjusted by the adjusting mechanism.

12. Multifunction case according to claim 7, further including analysis means for analyzing the image of said one or several displays of the watch in order to determine a value of said one or several displays among: the hour; the minutes; the seconds; the date, moon phases; the calendar; the wake-up time.

13. Multifunction case according to claim 12, wherein the analysis means further enable a gap between the value of said one or several displays and the current time and/or date to be ascertained, in order to determine a running state of the watch.

14. Multifunction case according to claim 13, further including communication means for communicating the running state of the watch to an external service.

15. Multifunction case according to claim 7, wherein the visualization means and the display device are adapted for a user to enter information and for information supplied by the external service to be displayed.

16. Multifunction case according to claim 15, wherein said information include information on after-sale services, technical solutions and/or information regarding new products and new commercial offers.

17. Multifunction case according to claim 1, further including a tracking device designed to determine a localization value of the case.

18. Multifunction case according to claim 17, wherein the adjusting mechanism is adapted for using the localization value so as to adjust said one or several displays according to the local time zone.

19. Multifunction case according to claim 1, further including control electronics controlling the adjusting mechanism so as to select one of said one or several displays adjusted by the adjusting mechanism.

20. Multifunction case according to claim 1, further including an acoustic measuring device for determining a frequency and/or amplitude of the movement of the watch so as to ascertain a running state of the watch.

21. Multifunction case according to claim 20, wherein the acoustic measuring device includes a microphone integrated in the support and designed for measuring the shocks of an escapement of a movement of the watch.

22. Multifunction case according to claim 1, further including an optical measuring device designed for visually measuring oscillations of the balance of the movement of the watch.

23. Multifunction case according to claim 1, in combination with an automatic or manual watch and having one or several displays.

* * * * *